US009656484B2

(12) United States Patent
Boo et al.

(10) Patent No.: US 9,656,484 B2
(45) Date of Patent: May 23, 2017

(54) MEDIA OUTPUT GUIDE ASSEMBLY

(71) Applicant: HEWLETT-PACKARD DEVELOPMENT COMPANY, L.P., Houston, TX (US)

(72) Inventors: Keng Aik Alan Boo, Singapore (SG); Kok Chai Chong, Singapore (SG); Ah Chong Tee, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/787,420

(22) PCT Filed: Jul. 29, 2013

(86) PCT No.: PCT/US2013/052523
§ 371 (c)(1),
(2) Date: Oct. 27, 2015

(87) PCT Pub. No.: WO2015/016810
PCT Pub. Date: Feb. 5, 2015

(65) Prior Publication Data

US 2016/0082750 A1 Mar. 24, 2016

(51) Int. Cl.

| | |
|---|---|
| ***B41J 11/00*** | (2006.01) |
| ***B41J 13/10*** | (2006.01) |
| ***B65H 29/70*** | (2006.01) |

(52) U.S. Cl.
CPC ..... *B41J 11/005* (2013.01); *B41J 13/106* (2013.01); *B65H 29/70* (2013.01);
(Continued)

(58) Field of Classification Search
CPC ..... B41J 11/005; B41J 13/106; B65H 29/70; B65H 2404/1115; B65H 2404/61;
(Continued)

(56) References Cited

U.S. PATENT DOCUMENTS

| | | | | |
|---|---|---|---|---|
| 5,738,454 A | | 4/1998 | Zepeda et al. | |
| 5,769,412 A | * | 6/1998 | Takemoto | B65H 29/70 271/119 |

(Continued)

FOREIGN PATENT DOCUMENTS

| | | | | |
|---|---|---|---|---|
| JP | 1992-0280836 | * | 9/1992 | B65H 31/00 |
| JP | 2000053304 | | 2/2000 | |
| JP | 2003270573 | | 9/2003 | |

OTHER PUBLICATIONS

International Searching Authority, The International Search Report and the Written Opinion, Apr. 23, 2014, 11 Pages.
(Continued)

*Primary Examiner* — Henok Legesse
(74) *Attorney, Agent, or Firm* — HP Inc, Patent Department

(57) ABSTRACT

A printer includes a print zone, and a media output guide assembly downstream of the print zone to curve media between media side edges. The media output guide assembly includes: an inner guide; and a pair of outer guides, the media to pass between the inner guide and the outer guides with the inner guide above the media and the outer guides below the media. The media passing between the guides has, in a direction perpendicular to a media output direction, outer edges that droop around and below a top of the outer guides, elevated points at the tops of the outer guides and a central low point under the inner guide and between the outer edges.

12 Claims, 6 Drawing Sheets

(52) U.S. Cl.
CPC ..... *B65H 2301/51214* (2013.01); *B65H 2403/41* (2013.01); *B65H 2404/1115* (2013.01); *B65H 2404/1521* (2013.01); *B65H 2404/61* (2013.01); *B65H 2404/693* (2013.01); *B65H 2511/216* (2013.01); *B65H 2801/06* (2013.01)

(58) Field of Classification Search
CPC ..... B65H 2404/1521; B65H 2404/693; B65H 2511/216; B65H 2801/06; B65H 2403/41; B65H 2301/51214
USPC ..... 347/104, 101, 102; 271/209
See application file for complete search history.

(56) References Cited

U.S. PATENT DOCUMENTS 5,975,521 A * 11/1999 Ono ..... B65H 29/70 271/188
6,148,727 A * 11/2000 Parthasarathy ..... B65H 29/34 101/417
6,238,114 B1 * 5/2001 Bennett et al. ..... 400/625
6,503,011 B2 * 1/2003 Kono ..... B41J 13/106 271/188
6,634,745 B2 * 10/2003 Tanno ..... B41J 13/106 347/104
7,686,295 B2 * 3/2010 Kawaguchi ..... B65H 29/242 271/188
7,809,323 B2 10/2010 Johnston et al.
7,810,805 B2 10/2010 Suzuki
8,205,879 B2 6/2012 Fujita et al.
2003/0227527 A1 * 12/2003 Richards ..... B41J 11/002 347/102
2007/0025789 A1 2/2007 Lee
2007/0025796 A1 * 2/2007 James ..... B41J 13/076 400/637.3
2008/0224383 A1 9/2008 Feygelman
2009/0244634 A1 * 10/2009 Hasegawa ..... B41J 2/04508 358/3.23
2011/0062657 A1 3/2011 Williams et al.
2013/0044170 A1 * 2/2013 Chiwata ..... B41J 11/0015 347/102

OTHER PUBLICATIONS

Xerox, Using the Sheet Enhancement Module to Manage Paper Curl. Xerox Nuvera. http://www.support.xerox.com/docu/NuveraEA_cd/ugta/english/adj_10.htm. Downloaded Oct. 19, 2015.

* cited by examiner

MEDIA OUTPUT GUIDE ASSEMBLY

BACKGROUND

Media may have a tendency to curl. This may complicate a proper output or stacking of printed media.

BRIEF DESCRIPTION OF THE DRAWINGS

For the purpose of illustration, certain examples constructed in accordance with this disclosure will now be described with reference to the accompanying drawings, in which.

DETAILED DESCRIPTION

In the following detailed description, reference is made to the accompanying drawings. The examples in the description and drawings should be considered illustrative and are not intended as limiting to the specific example or element described. Multiple examples of printers or media output guide assemblies can be derived from the following description and drawings through modification, combination or variation of the different elements.

Figure 1:
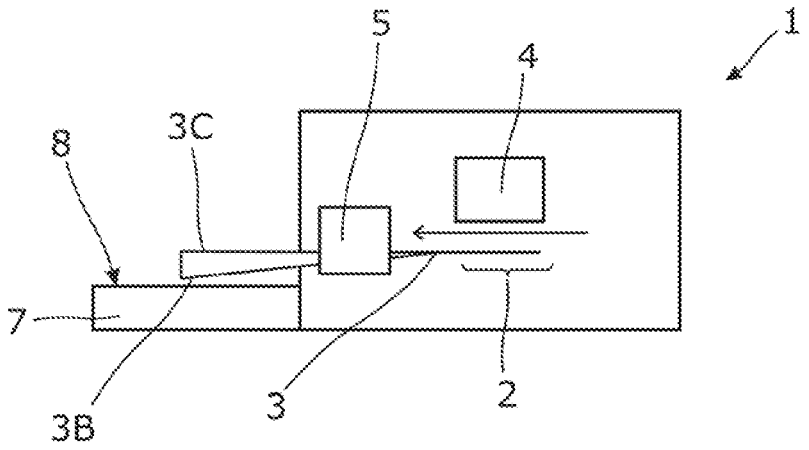
FIG. 1 illustrates an example of a diagram of a printer.

FIG. 1 illustrates an example of a printer 1. The printer 1 includes a print zone 2. The print zone 2 can be defined as the region where advancing media 3 is printed upon. In one example a print platen is provided in the print zone 2. The printer 1 includes an imaging arrangement 4 to print onto the media 3 in the print zone 2. For example, the print zone is defined by the imaging arrangement 4.

The imaging arrangement 4 can be an electrophotographic or inkjet imaging arrangement. Examples of the imaging material are liquid or dry toner or ink. In one example the imaging arrangement 4 includes a receiving bay fixed to the printer 1 to receive an exchangeable cartridge that holds the imaging material. In other examples the imaging arrangement 4 includes a printhead assembly that is fixed to the printer 1, wherein the printhead assembly can be a scanning or a page wide array printhead assembly.

In one example the printer 1 includes a media output tray 7. The media output tray 7 includes a media support surface 8 to support the media 3 or media stack.

The printer 1 includes a media output guide assembly 5 to curve the media 3 downstream of the print zone 2. A media output direction M runs from right to left in FIG. 1. The media output guide assembly 5 is to curve a middle portion 3B of the media 3 by engaging the media 3 downstream of the print zone 2. In one example the middle portion 3C is curved so that it exhibits a U-shape. In one example the middle portion 3C is curved towards the media support surface 8. In the illustrated example the middle portion 3C is curved downwards so that media side portions 3C are above the middle portion 3B. In other, not illustrated examples the media 3 may be stacked in an inclined or approximately vertical orientation or directly on a desk or table top. In these examples the "belly" of the U-shaped media would be directed towards the media support surface, that is, the media tray or desk or table top.

In a further example explanation, just after the print zone 2 the recently deposited imaging material may be wet, cooling down, drying, curing, fusing or undergoing some kind of temperature or state change. As a result thereof the media 3 may tend to curl. In again further examples certain media types, such as for example relatively thin paper or short grained paper, are extra sensitive to curl, especially in combination with the imaging material being wet, cooling down, drying, curing, fusing or undergoing some kind of temperature or state change. Intentionally curving the media 3 at output may help in these and other example situations. For example, curving the media 3 after the print zone 2 can inhibit curling of the media 3 over a direction perpendicular to the media output direction M. For example, the curving of the media 3 after the print zone 2 may stiffen the media 3 at output.

Figure 2:
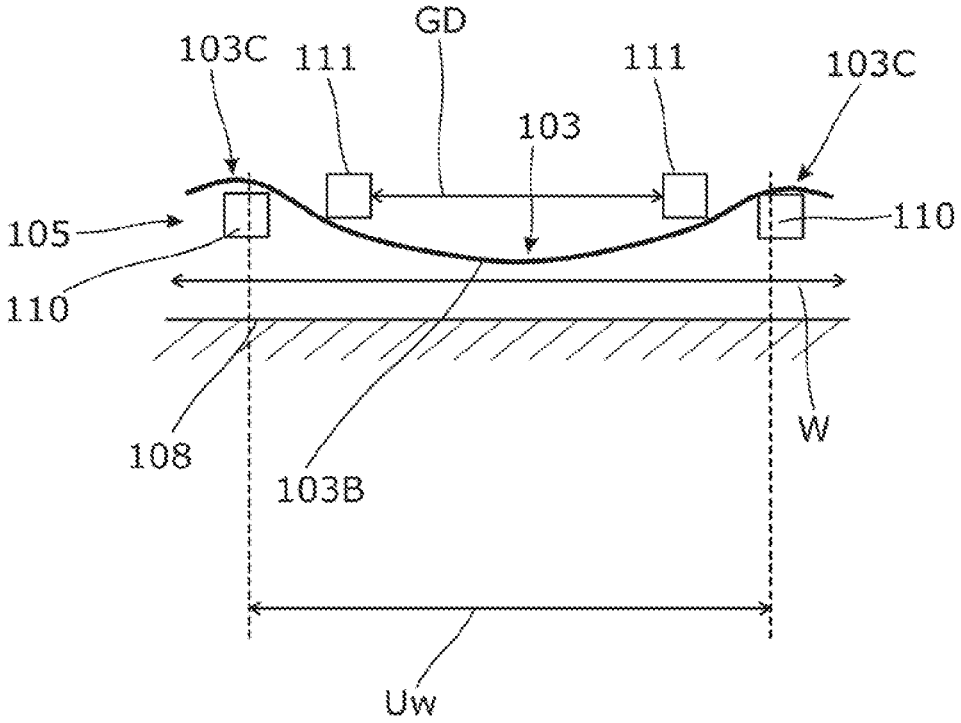
FIG. 2 illustrates an example of a diagram of a transverse cross section of a media output guide assembly and curved media.

FIG. 2 illustrates an example diagram of a media output guide assembly 105 and a transverse cross section of media 103 advancing through the media output guide assembly 105. The media 103 represents recently or currently printed media 103. For example the media 103 is output or ejected towards the viewer. The media output direction could be horizontal, upwards or inclined with respect to a horizontal. Different printer types may have different ways of ejecting and stacking media.

In the example of FIG. 2 the media output guide assembly 105 is provided with four example guides, of which two first guides 110 and two second guides 111. As illustrated, the media output guide assembly 105 is to direct a middle portion 103B towards a media support surface 108 and side portions 103C away from the media support surface 108 so that the transverse cross section of the output media 103 includes a U-type shape. In one example the media support surface 108 is a support surface of a printer output tray that may be horizontal, inclined, or almost vertical. In another example the media support surface 108 is formed by a desk top surface on which a respective printer is placed, that is, the printer is to stack printed media onto the desktop on which it is placed.

In the example illustration, the first guide 110 contacts a first face of the printed media, while the second guide 111 contacts the opposite face of the printed media 103. The second guide 111 presses into the media 103 to bow the middle portion 103B towards the media support surface 108, while the first guides 110 hold the side portions 103C away from the media stack surface 108 so that the U-shaped cross section is formed. The point where the second guide 111 is to engage the media 3 is closer to the media support surface 108 than the point where the first guide 110 is to engage the media 3. As illustrated, in operation, the U-shape in the media 103 may span between the first guides 110 and its width Uw may span more than half of a width W of a print zone and/or media output tray support surface. In a further example the distance GD between the inner second guides 111 is more than half of the width W of the print zone and/or media output tray support surface. For example the formed "belly" of the U-shaped media is relatively wide.

In other examples the media output guide assembly 105 may include other numbers of guides 110, 111, such as for example only one second guide 111 to push the middle portion 103C towards the media support surface 108.

Figure 3:
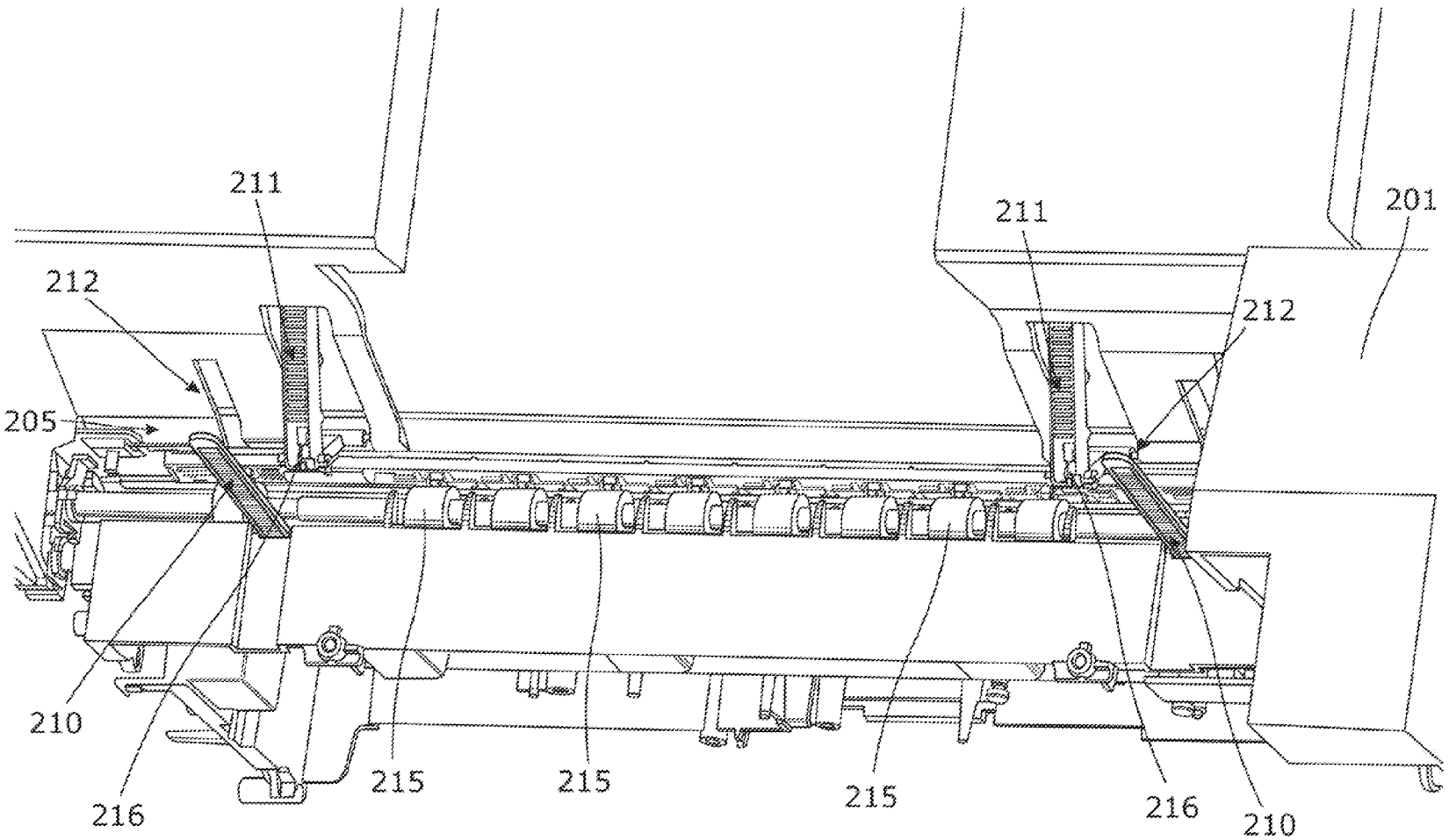
FIG. 3 illustrates a portion of an example printer with an example media output guide assembly in perspective view.
Figure 4:
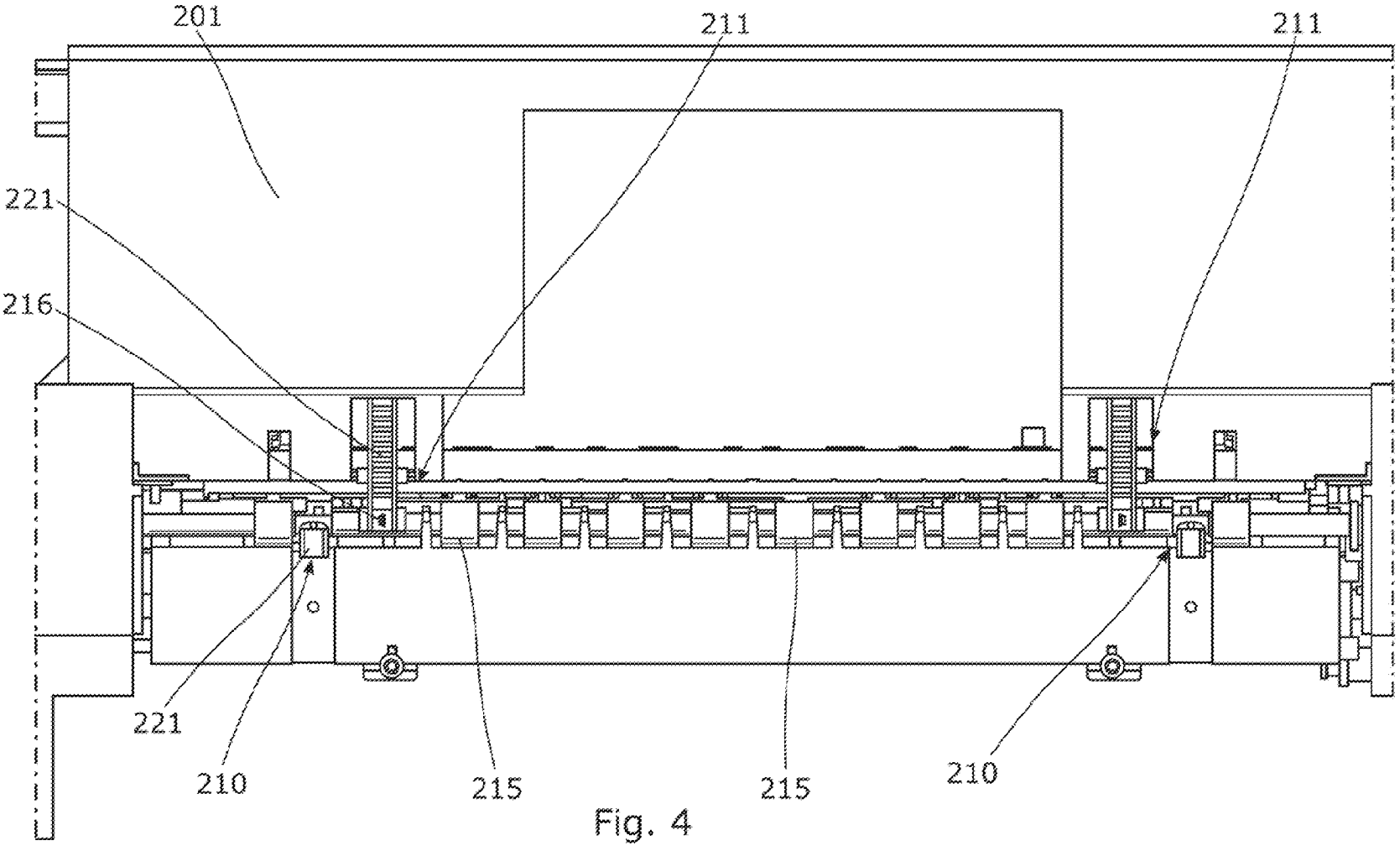
FIG. 4 illustrates a portion of the example printer with example media output guide assembly of FIG. 3 in front view.
Figure 5:
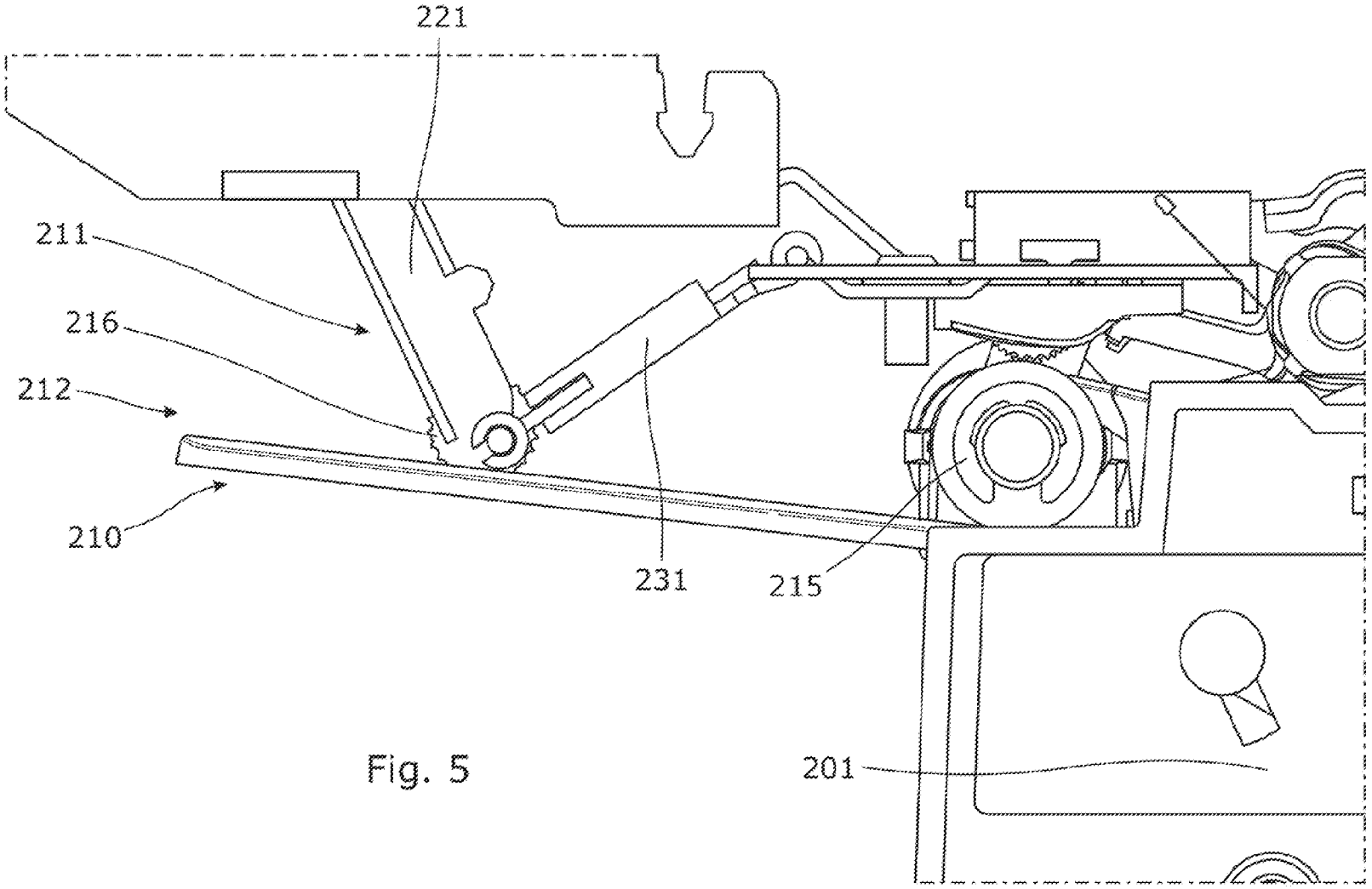
FIG. 5 illustrates a portion of the example printer with example media output guide assembly of FIGS. 3 and 4, in side view.
Figure 6:
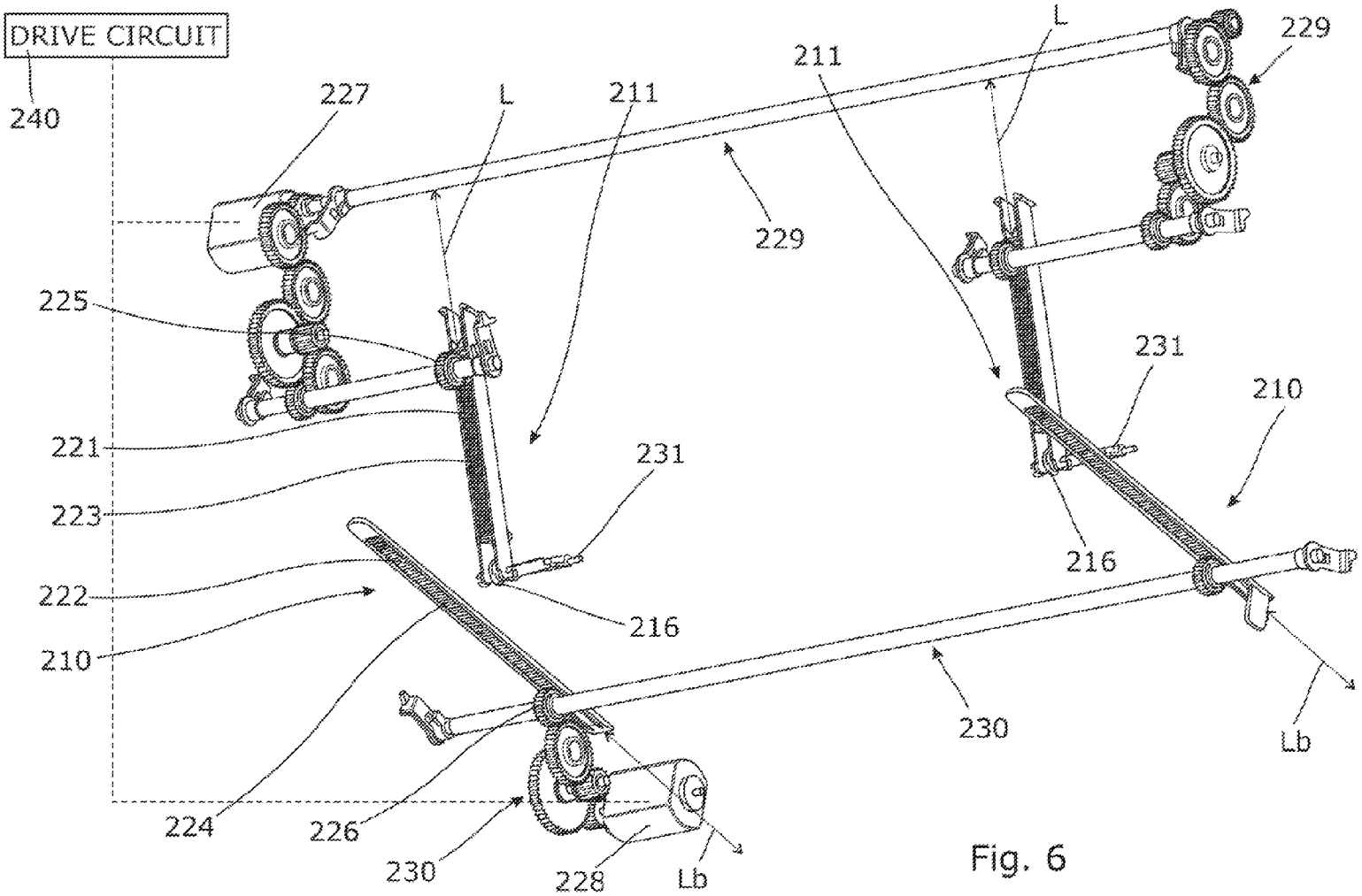
FIG. 6 illustrates the individual example media output guide assembly of FIGS. 3-5 in perspective view.

FIGS. 3-5 illustrate a portion of an example printer 201 including an example media output guide assembly 205 and FIG. 6 shows the individual media output guide assembly 205 of FIGS. 3-5. In an example, the printer 201 includes output rollers 215. The output rollers 215 are disposed near the print zone for example downstream of the print zone, for example at the edge of the print zone. The output rollers 215 are to aid in advancing the media during printing. For example, the output rollers 215 are to eject the media from the printer 201. In an example bottom output rollers 215 are disposed over the width of the printer to engage a face of the printed media that is not currently being printed. For example, the output rollers 215 are to eject the media towards the media stack through a short acceleration, allowing the media to be advanced over a certain distance and then fall down onto a media support surface by gravity. The media output guide assembly 205 is arranged downstream of the print zone and downstream of the media output rollers 215 to curve the printed media that is advanced by the output rollers 215. In certain examples the output rollers 215 are also arranged to return printed media for duplex printing.

The media output guide assembly 205 includes two top guides 211 to engage a top face of printed media. In an example the top face is the image face of the printed media. In case of duplex printing the image face is the face that is being printed, and/or the face with the most recently printed image. In one example the top guide 211 includes a low friction element to roll or slide over the image face during printing. For example the top guide 211 includes low friction wheel 216 such as a star wheel to roll over the image face during printing.

The media output guide assembly 205 includes two bottom guides 210 to engage a bottom face of printed media. The bottom guides 210 are arranged next to the top guides 211 on the outside of the top guides 211. In an example the bottom face is the face of the media that is not being printed, or, in case of duplex printing, the face that was first printed. For example, in case of duplex printing the image on the bottom face may have already cooled down, cured, dried, fused, etc., so that there is less risk that the bottom guides 210 engage wetted imaging material. In one example the bottom guides 210 include a slide element such as a ski-like structure so that during media output the bottom face of the media slides over the bottom guide 210.

The guides 210, 211 are arranged in pairs 212 wherein each pair 212 contains a bottom guide 210 and a top guide 211. The distance between a bottom guide 210 and a top guide 211 within a pair 212 is smaller than the distance between the pairs 212. The top guides 211 are disposed on the inside so that the distance between the top guides 211 is smaller than the distance between the bottom guides 212. Consequently, in this example, the distance between the pairs 212 is determined by the distance between the top guides 211.

A point of the top guides 211 that is to engage the media is lower than a point of the bottom guides 210 that is to engage the media. This is perhaps best viewable in FIG. 5. The top guides 211 are arranged on the inside of the bottom guides 210 and by having the engagement point lower than the engagement point of the bottom guides 210 the top guides 211 press the middle portion of the media down, that is, in operation. In turn, the bottom guides 210 are to press side portions of the media, on both sides of the middle portion, upwards so that a U-shape is formed in the output media, as diagrammatically illustrated in FIG. 2.

In one example that is perhaps best understood with reference to FIGS. 5 and 6 at least one of the guides 210, 211 is retractable. For example at least the bottom guides 210 are retractable. In the illustrated example, both the top and bottom guides 211, 210 are retractable. In one example, the guides 210, 211 are to retract just before the output rollers 215 eject the printed media.

In an example the retractable top guide 211 includes a retractable arm 221. In a further example, the arm 221 includes a rack 223 that is engaged by a pinion 225 or gear that in turn is drivable by a motor 227 (FIG. 6). For example, further transmission elements 229 are to transmit motor axle rotation to the pinion 225 and, finally, to the guide wheel 216. These further transmission elements 229 may include gears and axles. Both two top guides 211 may be drivable by the same motor 227 through said transmission elements 229.

For example, the arm 221 is retractable and extendable over a straight line L over its own longitudinal axis. For example the top guide 211 includes a pivoting arm 231 to support and guide the retractable arm 221 during retraction and extension of the top guide 211. One end of the pivoting arm 231 pivots with respect to the retractable arm 221 and another end is mounted to a printer part in a pivoting manner and has a fixed location. In an example, the pivoting arm 231 is telescopic. For example the arm 221 is to retract substantially upwards and extend substantially downwards.

In an example the retractable bottom guide 210 also includes a retractable arm 222. In a further example, the bottom arm 222 includes a rack 224 that is engaged by a pinion 226 or gear that in turn is drivable by a motor 228. For example, further transmission elements 230 are to transmit motor axle rotation to the pinion 226 and, finally, to the bottom guide arm 222. The further transmission elements may include gears and axles. Both two bottom guides 222 may be drivable by the same motor 228 through said transmission elements 230.

For example, the bottom arm 222 is retractable and extendable over a straight line Lb over its own longitudinal axis. For example the bottom arm 22 is extendable away from the print zone and retractable towards and partly under the print zone.

The printer 201 includes a drive circuit 240 to instruct the drive of the bottom and top guide 210, 211. In the discussed example such guide drive includes motors 227, 228. For example the guide drive includes open loop DC motors. For example, the drive circuit 240 is to instruct the guide drive to extend and retract the guides 210, 211. For example the drive circuit 240 is to instruct the guide drive to extend and retract the guides 210, 211 before a trailing media edge passes and/or before the media is ejected. For example the drive circuit 240 is to instruct the media output rollers 215 to eject the media just after the guides 210, 211 are ejected.

Figure 7:
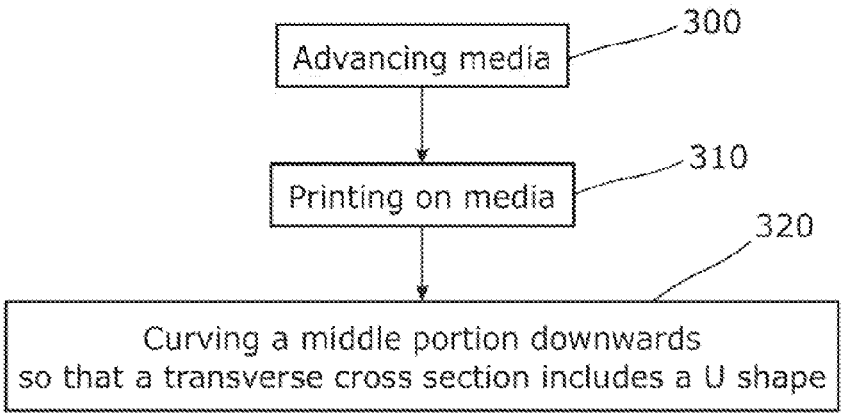
FIG. 7 illustrates a flow chart of an example method of printing and ejecting media.

FIG. 7 illustrates a flow chart of an example of a method of printing and ejecting media. For example the method includes advancing media over a print zone (block 300). For example the method includes printing on the advancing media (block 310). For example the method includes, during said printing, curving a middle portion of the media towards a media support surface so that a transverse cross section of the media includes a U shape (block 320). Such curving may occur downstream of the print zone.

Figure 8:
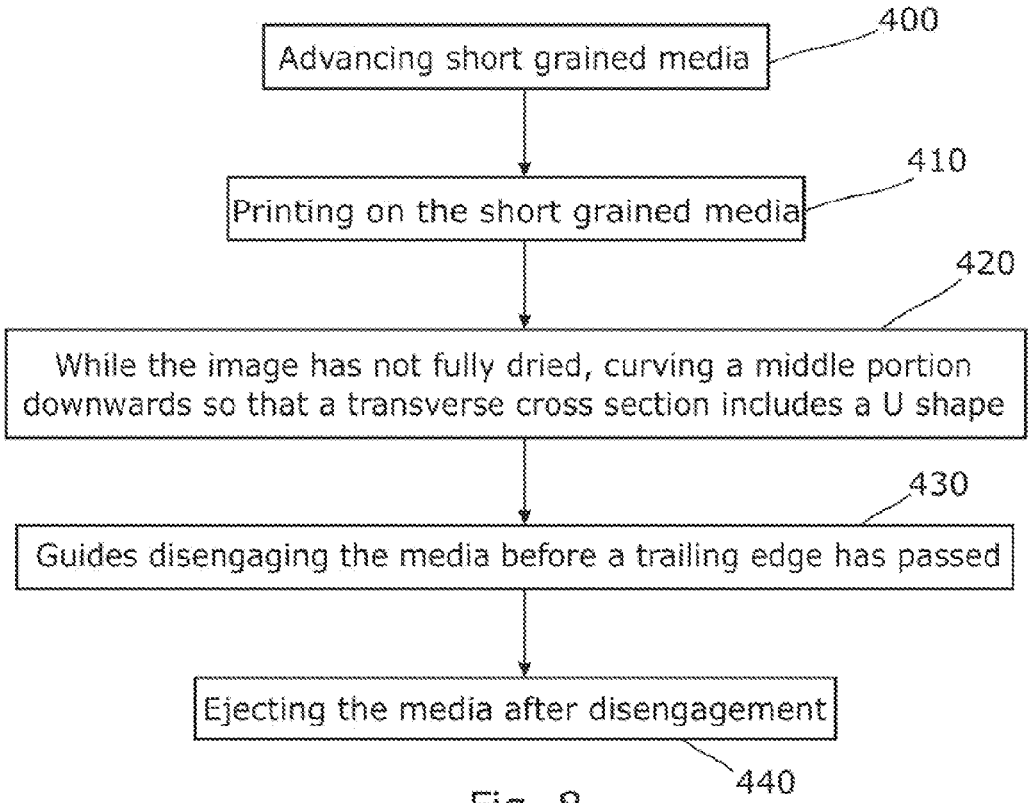
FIG. 8 illustrates a flow chart of another example method of printing and ejecting media.

FIG. 8 illustrates a flow chart of another example of a method of printing and ejecting media. For example the method includes advancing media over a print zone, wherein a general grain direction of grains in the media is perpendicular to the media advance direction (block 400). For example, the media is advanced in a landscape orientation or the media includes short grain paper. Here, the grain direction can be defined as a direction of the length of the grains. Here, short grained paper can be defined as paper wherein a length direction of the fibers in the paper is generally aligned with a short edge of the paper. For example the method includes printing on the advancing media (block 410), wherein the grain direction is perpendicular to the media advance direction.

In this example the media has a grain direction perpendicular to the media advance direction during printing. Therefore the fibers may offer relatively little resistance to curling and the short grained media may have a relatively strong tendency to curl at ejection, especially when the image has not fully dried, cured, fused or cooled down. In one example the method includes, while the image has not fully dried, cured, fused or cooled down, curving a middle portion of the media downwards so that a transverse cross section of the media includes a U shape (block 420). In one example this allows the short grain media to be stiffened and may prevent curling. The method includes a disengagement of the media by guides before a trailing edge has passed these guides (block 430). The method includes ejecting the media after the guides have disengaged the media (block 440).

While in this description directional indications including "bottom", "top", "downwards", and "upwards" are used, these can be interpreted as relative. For example the examples mentioned with respect to FIGS. 3-6 could also be implemented in a printer that has an approximately vertical or inclined media output tray. In such assembly, similar media output guide assemblies can be applied.

The invention claimed is:

1. A printer comprising a print zone, and a media output guide assembly downstream of the print zone to curve media between media side edges, the media output guide assembly comprising:

two inner guides that are spaced apart; and a pair of outer guides disposed lower than and laterally outside of the two inner guides, the media to pass between the inner guides and the outer guides with the inner guides above the media and the outer guides below the media;

such that the media passing between the guides has, in a direction perpendicular to a media output direction, outer edges that droop around and below atop of the outer guides, elevated points at the tops of the outer guides and a central low point that droops below both the inner and outer guides, there being no guide member contacting a resulting U-shaped bow in the media between the inner guides and a distance between the inner guides is at least half of a width of the print zone.

2. The printer of claim 1, wherein each guide is unopposed by any additional guide element on an opposite side of the media.

3. The printer of claim 1, wherein the inner guides comprise a rolling element to roll over advancing media and the outer guides comprise an elongated ski structure over which advancing media slides.

4. The printer of claim 1, wherein the media output guide assembly comprises at least one retractable guide having an elongated arm to extend retract along its own longitudinal axis which is parallel to the media output direction during media ejection.

5. The printer of claim 4 comprising a guide drive, and a drive circuit to instruct the guide drive to extend and retract the at least one retractable guide using a rack and pinion.

6. The printer of claim 1 wherein the media output guide assembly comprises a wheel to roll over an image face being printed.

7. The printer of claim 1 wherein the media output guide assembly comprises an arm to slide over a media face that is opposite to an image face.

8. A printer comprising:

a media guide downstream of a media print zone comprising guides to curve a U shape in the printed media at ejection to stiffen partly wet media at ejection;

a motorized system to extend and retract an element of the media guide in a media output direction during ejection of the printed media, the element extended and retracted comprising an arm that extends and retracts along a straight line on its own longitudinal axis which is parallel to the media output direction;

two inner guides that are spaced apart; and a pair of outer guides disposed lower than and laterally outside of the two inner guides, the media to pass between the inner guides and the outer guides with the inner guides above the media and the outer guides below the media;

such that the media passing between the guides has, in a direction perpendicular to a media output direction, outer edges that droop around and below a top of the outer guides, elevated points at the tops of the outer guides and a central low point that droops below both the inner and outer guides, there being no guide member contacting a resulting U-shaped bow in the media between the inner guides and a distance between the inner guides is at least half of a width of the print zone.

9. The printer of claim 8, wherein the outer guides are also connected to the motorized system so that the outer guides are extended and retracted in the media output direction during ejection of the printed media.

10. The printer of claim 8, wherein the inner guide comprises a guide wheel to roll over a surface of the printed media during ejection of the printed media.

11. The printer of claim 8, wherein the motor zed system comprises:

a retractable arm supporting the element of the media guide; and a telescopic pivoting arm connected between the retractable arm and a stationary printer part.

12. The printer of claim 11, wherein the retractable arm comprises:

a rack;

a pinion or gear to interface with the rack;

the pinon or gear connected to a motor of the motorized system to selectively extend and retract the retractable arm.

* * * * *